US006860589B2

(12) United States Patent
Tamura

(10) Patent No.: US 6,860,589 B2
(45) Date of Patent: Mar. 1, 2005

(54) JETTING APPARATUS

(75) Inventor: Noboru Tamura, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/355,270

(22) Filed: Jan. 31, 2003

(65) Prior Publication Data

US 2003/0146954 A1 Aug. 7, 2003

(30) Foreign Application Priority Data

Jan. 31, 2002 (JP) ..... P2002-024856

(51) Int. Cl.[7] ..... B41J 2/14
(52) U.S. Cl. ..... 347/50

(58) Field of Search ..... 347/49, 50, 58–59, 347/84–87, 6–7; 400/175

*Primary Examiner*—K. Feggins
(74) *Attorney, Agent, or Firm*—Sughrue Mion, PLLC

(57) ABSTRACT

A jetting head is provided with a plurality of rows of nozzles, a plurality of pressure generating elements associated with the respective nozzles to generate pressure to eject jetted objects from the nozzles. A head driver generates a drive signal and a ground signal to be supplied to each of the pressure generating elements. A plurality of flexible flat cables include signal lines connecting the head driver and the jetting head. The flexible flat cables are arranged such that a first signal line for supplying the drive signal to one of the nozzle rows is provided in one of the flat cables and a second signal line for supplying the ground signal to the one of the nozzle rows opposes to the first signal line while being provided in another one of the flat cables.

22 Claims, 4 Drawing Sheets

10

| FFC1 | | | FFC2 | | |
|---|---|---|---|---|---|
| | LINE NUMBER | SIGNAL NAME | | LINE NUMBER | SIGNAL NAME |
| ROW A | 1 | COMA | ROW A | 1 | AGNDA |
| | 2 | AGNDA | | 2 | COMA |
| ROW B | 3 | COMB | ROW B | 3 | AGNDB |
| | 4 | AGNDB | | 4 | COMB |
| ROW C | 5 | COMC | ROW C | 5 | COMC |
| | 6 | AGNDC | | 6 | AGNDC |
| ROW D | 7 | COMD | ROW D | 7 | COMD |
| | 8 | AGNDD | | 8 | AGNDD |
| | ⋮ | | | ⋮ | |

20

| FFC1 | | | FFC2 | | |
|---|---|---|---|---|---|
| | LINE NUMBER | SIGNAL NAME | | LINE NUMBER | SIGNAL NAME |
| ROW A | 1 | COMA | ROW A | 1 | AGNDA |
| | 2 | AGNDA | | 2 | COMA |
| | 3 | COMA | | 3 | AGNDA |
| ROW B | 4 | AGNDB | ROW B | 4 | COMB |
| | 5 | COMB | | 5 | AGNDB |
| | 6 | AGNDB | | 6 | COMB |
| ROW C | 7 | COMC | ROW C | 7 | AGNDC |
| | 8 | AGNDC | | 8 | COMC |
| | 9 | COMC | | 9 | AGNDC |
| ROW D | 10 | AGNDD | ROW D | 10 | COMD |
| | 11 | COMD | | 11 | AGNDD |
| | 12 | AGNDD | | 12 | COMD |
| | | ⋮ | | | ⋮ |

FIG. 6
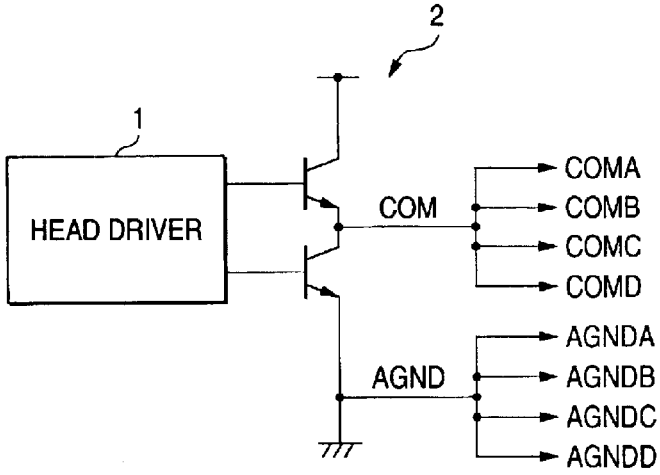
FIG. 7
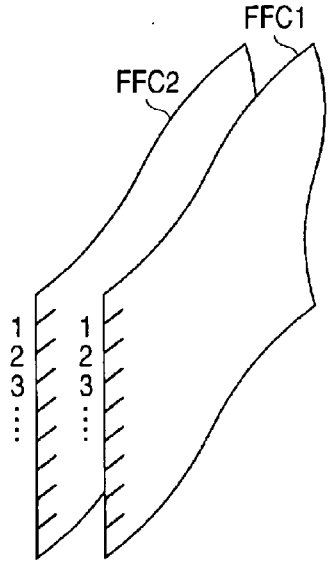
FIG. 8
| | FFC1 | | | FFC2 | |
|---|---|---|---|---|---|
| | LINE NUMBER | SIGNAL NAME | | LINE NUMBER | SIGNAL NAME |
| ROW A | 1 | COMA | ROW C | 1 | AGNDC |
| | 2 | AGNDA | | 2 | COMC |
| | 3 | COMA | | 3 | AGNDC |
| | 4 | AGNDA | | 4 | COMC |
| ROW B | 5 | COMB | ROW D | 5 | AGNDD |
| | 6 | AGNDB | | 6 | COMD |
| | 7 | COMB | | 7 | AGNDD |
| | 8 | AGNDB | | 8 | COMD |
| | ⋮ | | | ⋮ | |

JETTING APPARATUS

BACKGROUND OF THE INVENTION

The invention relates to a jetting head capable of ejecting various kinds of liquid in the form of droplets for use in an ink jet printer, a display manufacturing apparatus, an electrode forming apparatus, a biochip manufacturing apparatus, etc., and more particularly, to a jetting apparatus having a plurality of flexible flat cables to be used for supplying drive signals from a head driver to a jetting head.

As a jetting apparatus having a jetting head capable of ejecting liquid in the form of a liquid droplet, for example, there has been proposed an ink jet printer in which ink droplets are ejected to record an image or the like on recording paper, an electrode forming apparatus in which an electrode material in a liquid form is ejected onto a substrate to thereby form electrodes, a biochip manufacturing apparatus in which biological samples are ejected to manufacture biochips, or a micropipette for ejecting a predetermined amount of a sample into a vessel.

For instance, in an ink jet printer employing piezoelectric elements as drive elements for ejecting ink, a plurality of piezoelectric elements, which are provided so as to correspond to a plurality of nozzles of a print head, are selectively activated, whereby ink droplets are ejected from the nozzles in accordance with the dynamic pressure generated by the respective piezoelectric elements. Dots are formed on recording paper by causing the ink droplets to adhere to the recording paper, thus effecting printing operation.

Here, the piezoelectric elements are provided so as to correspond to nozzles to be used for ejecting ink droplets. The piezoelectric elements are actuated by a drive signal supplied from a head driver mounted in the print head, thereby ejecting ink droplets.

Drive signals output from the head driver are sent to a print head by way of a flexible flat cable.

More specifically, as shown in FIG. 6, a drive signal COM output from a head driver 1 is divided for respective rows of color nozzles. In relation to a row of nozzles A (hereinafter simply called a "nozzle row A" or "row A"), the head driver 1 outputs, to the print head and over a flexible flat cable, a drive signal COMA and a ground signal AGNDA serving as a return signal for the drive signal COMA. In relation to a row of nozzles B (hereinafter simply called a "nozzle row B" or "row B"), the head driver 1 outputs, to the print head and over the flexible flat cable, a drive signal COMB and a ground signal AGNDB serving as a return signal for the drive signal COMB. In relation to a row of nozzles C (hereinafter simply called a "nozzle row C" or "row C"), the head driver 1 outputs, to the print head and over the flexible flat cable, a drive signal COMC and a ground signal AGNDC serving as a return signal for the drive signal COMC (a signal in which the same current flows in a direction opposite to the drive signal). In relation to a row of nozzles D (hereinafter simply called a "nozzle row D" or "row D"), the head driver 1 outputs, to the print head and over the flexible flat cable, a drive signal COMD and a ground signal AGNDD serving as a return signal for the drive signal COMD.

Here, the drive signals COMA, COMB, COMC, COMD, and the ground signals AGNDA, AGNDB, AGNDC, AGNDD assume the form of a relatively large electric current. For instance, as shown in FIG. 8, each of signal lines corresponding to the respective signals is split into a plurality of signal lines; e.g., two signal lines. The drive signal and the ground signal are connected in parallel to each other by way of the thus-split signal lines. In view of the number of signal lines provided in a flexible flat cable, two flexible flat cables FFC1, FFC2 are used, as shown in FIG. 7.

In connection with the nozzle rows A, B, C, and D assigned to respective colors of the print head, as shown in FIG. 8, the drive and ground signals are allocated, on a per-row basis, to the signal lines of the respective flexible flat cables FFC1, FFC2. Specifically, the drive signal COMA for the nozzle row A and the ground signal AGNDA serving as a return signal for the drive signal COMA are allocated to signal lines such that the drive signal and the ground signal are arranged alternately. The drive signal COMB and the ground signal AGNDB serving as a return signal for the drive signal COMB are allocated to signal lines in the same manner. The drive signal COMC and the ground signal AGNDC serving as a return signal for the drive signal COMC are allocated to signal lines in the same manner. Further, the drive signal COMD and the ground signal AGNDD serving as a return signal for the drive signal COMD are allocated to signal lines in the same manner.

As shown in FIG. 7, the flexible flat cables FFC1, FFC2 are set within the printer main unit while remaining superimposed.

In an ink jet printer having the flexible flat cables FFC1, FFC2 of such a configuration, the head driver sends a drive signal and a corresponding ground signal to the print head on a per-color-row basis over the signal lines of the respective flexible flat cables FFC1, FFC2. As a result, piezoelectric elements provided in the print head are driven by the drive signal, and nozzles associated with the piezoelectric elements eject ink droplets, thus effecting printing operation.

In this case, the drive signal lines and the ground signal lines are allocated on a per-row basis. In particular, the nozzle rows A and B and the nozzle rows C and D are thoroughly separated from each other. Eventually, crosstalk developing between the drive and ground signals of the nozzle rows A, B and those of the nozzle rows C, D is reduced, thereby inhibiting occurrence of interference, which would otherwise arise between respective nozzle rows.

Consequently, when the nozzle row A is brought into, e.g., a total ON or OFF condition, there does not occur changes in waveforms of signals flowing through signal lines for the nozzle row B located adjacent to signal lines for the nozzle row A within the flexible flat cables FFC1, FFC2.

However, in the flexible flat cables FFC1, FFC2 having such a configuration, the signal lines of the flexible flat cable FFC1 are located adjacent to and oppose those of the flexible flat cable FFC2.

Therefore, in relation to combinations of signal lines in which the signal lines of the flexible flat cable FFC1 and those of the flexible flat cable FFC2 oppose each other; for instance, a combination of signal lines for the row A and those for the row C and a combination of signal lines for the row B and those for the row D illustrated in the drawings, mutually-opposing signal lines are located close to each other. Hence, crosstalk arises between the mutually-opposing signal lines for the rows, thereby inducing occurrence of interference between the rows (hereinafter, this phenomenon will be called "inter-row interference").

Accordingly, if an attempt is made to effect printing operation in cyan ink C by use of the row C during the course of printing operation being performed in yellow ink Y by use of the row A, the drive and ground signals allocated to the row C affect the drive and ground signals allocated to the row A, for reasons of inter-row interference, thereby disturbing waveforms of the drive and ground signals. As a result, minute changes develop in, e.g., the quantity of yellow ink Y to be ejected by the nozzle A. In particular, such minute changes appear in the form of a line on a printed image on recording paper at the time of printing of minute dots, thereby deteriorating print quality.

SUMMARY OF THE INVENTION

It is therefore an object of the invention to provide a jetting apparatus designed to improve jetting performance accuracy through use of a simple configuration and without being affected by interference developing in flexible flat cables.

In order to achieve the above object, according to the invention, there is provided a jetting apparatus, comprising:

- a jetting head, provided with a plurality of rows of nozzles, a plurality of pressure generating elements associated with the respective nozzles to generate pressure to eject jetted objects from the nozzles;
- a head driver, which generates a drive signal and a ground signal to be supplied to each of the pressure generating elements; and
- a plurality of flexible flat cables including signal lines connecting the head driver and the jetting head, the flexible flat cables arranged such that a first signal line for supplying the drive signal to one of the nozzle rows is provided in one of the flat cables and a second signal line for supplying the ground signal to the one of the nozzle rows opposes to the first signal line while being provided in another one of the flat cables.

In such a configuration, drive and ground signals assigned to one row of nozzles are allocated to different flexible flat cables so as to mutually oppose.

As a result, there can be prevented mutual opposition of drive signal lines and/or ground signal lines, both belonging to different rows of nozzles. Hence, interference developing between the drive signals and the ground signals, both belonging to these rows of nozzles, is reduced.

Hence, there is prevented occurrence of distortion of the waveforms of the drive and ground signals, which would otherwise be caused by interference developing between rows of nozzles, thus improving jetting performance accuracy.

Preferably, signal lines for supplying the drive signal and signal lines for supplying the ground signal are alternately arranged in each of the flexible flat cables.

In such a configuration, in relation to adjacent signal lines, magnetic fields developing as a result of flow of signals cancel each other, thus diminishing inductance.

Preferably, at least one of the first signal line and the second signal line is divided into a plurality of sublines.

In such a configuration, an electric current flowing through one signal line is reduced, thereby coping with a larger drive current.

It is preferable that: a third signal line for supplying the drive signal to another one of the nozzle rows is provided in one of the flat cables and a fourth signal line for supplying the ground signal to the another one of the nozzle rows opposes to the first signal line while being provided in another one of the flat cables; and jetting performances in the one of the nozzle rows and the another one of the nozzles affect with each other in relation to jetting performance accuracy.

For example, such a configuration may be adopted with respect to only rows of color nozzles in an ink jet color printer which affect printed image quality.

Preferably, each adjacent flexible flat cables are arranged with a gap therebetween.

Alternatively, it is preferable that a signal interference prevention member is provided between each adjacent flexible flat cables.

By such configurations, interference developing between respective flexible flat cables is surely eliminated, thereby improving jetting performance accuracy without involving occurrence of distortion in waveforms of the drive signals and those of the ground signals, which would otherwise be caused by interference arising between rows of nozzles.

According to the invention, there is also provided a jetting apparatus, comprising:

- a jetting head, provided with a plurality of rows of nozzles, a plurality of pressure generating elements associated with the respective nozzles to generate pressure to eject jetted objects from the nozzles;
- a head driver, which generates a drive signal and a ground signal to be supplied to each of the pressure generating elements; and
- a plurality of flexible flat cables including signal lines connecting the head driver and the jetting head, the flexible flat cables arranged such that a first signal line for supplying the drive signal to one of the nozzle rows is provided in one of the flat cables and a second signal line for supplying the drive signal to the one of the nozzle rows opposes to the first signal line while being provided in another one of the flat cables.

According to the invention, there is also provided a jetting apparatus, comprising:

- a jetting head, provided with a plurality of rows of nozzles, a plurality of pressure generating elements associated with the respective nozzles to generate pressure to eject jetted objects from the nozzles;
- a head driver, which generates a drive signal and a ground signal to be supplied to each of the pressure generating elements; and
- a plurality of flexible flat cables including signal lines connecting the head driver and the jetting head, the flexible flat cables arranged such that a first signal line for supplying the ground signal to one of the nozzle rows is provided in one of the flat cables and a second signal line for supplying the ground signal to the one of the nozzle rows opposes to the first signal line while being provided in another one of the flat cables.

BRIEF DESCRIPTION OF THE DRAWINGS

The above objects and advantages of the present invention will become more apparent by describing in detail preferred exemplary embodiments thereof with reference to the accompanying drawings, wherein:

FIG. 6 is a block diagram showing the configuration of a related-art ink jet printer;

FIG. 7 is a schematic perspective view showing flexible flat cables of the related-art ink jet printer; and FIG. 8 is a view showing allocation of the signal lines provided in the flexible flat cables of the related-art ink jet printer.

DETAILED DESCRIPTION OF THE PREFERRED EMBODIMENTS

Preferred embodiments of the invention will be described by reference to the accompanying drawings.

The embodiments to be described hereinbelow are preferred specific embodiments of the invention, and hence technically-preferable limitations are imposed on the embodiments. However, the scope of the invention is not limited to the embodiments, unless the following descriptions include descriptions which particularly specify the invention.

Figure 1:
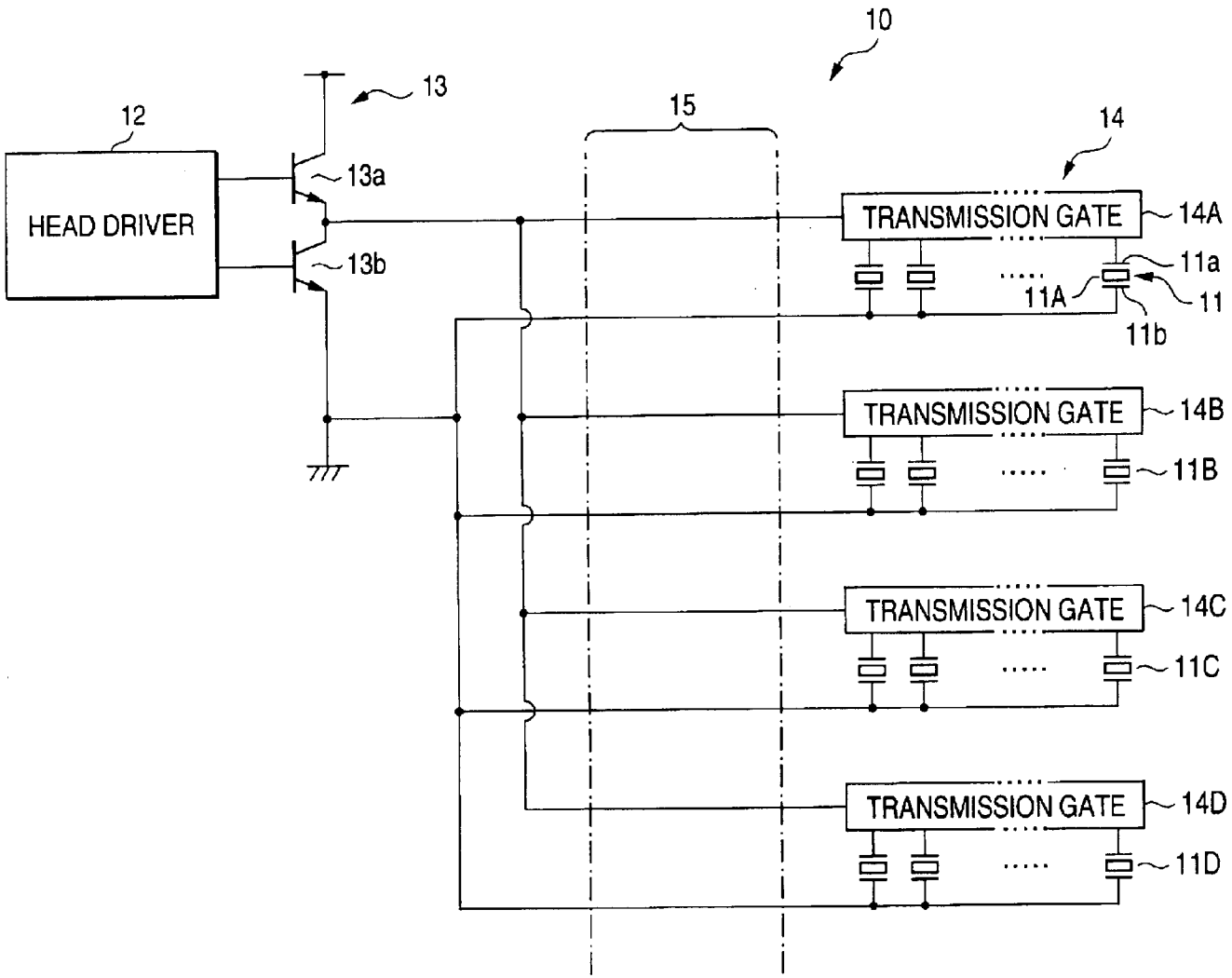
FIG. 1 is a block diagram showing the configuration of an ink jet printer according to a first embodiment of the invention.

As shown in FIG. 1, an ink jet printer 10 according to a first embodiment of the invention is provided with piezoelectric elements 11 arranged so as to correspond to rows of four color nozzles of the ink jet printer; a head driver 12 provided for supplying a drive signal to electrodes 11*a* of the piezoelectric elements 11; a current amplifier 13 interposed between the head driver 12 and the respective piezoelectric elements 11; and a switcher 14.

A row of nozzles are provided on a per-color basis in the ink jet print head, and the piezoelectric elements 11 are provided in each of the rows of nozzles.

Piezoelectric elements 11A are provided for a row of nozzles A (hereinafter simply called a "nozzle row A" or "row A"); piezoelectric elements 11B are provided for a row of nozzles B (hereinafter simply called a "nozzle row B" or "row B"); piezoelectric elements 11C are provided for a row of nozzles C (hereinafter simply called a "nozzle row C" or "row C"); and piezoelectric elements 11D are provided for a row of nozzles D (hereinafter simply called a "nozzle row D" or "row D").

Drive signals output from the head driver 12; that is, drive signals COMA, COMB, COMC, and COMD, are sequentially output to the respective piezoelectric elements 11 by way of shift registers.

The piezoelectric elements 11 are embodied by, e.g., elements exhibiting the piezoelectric effect and formed so as to become deformed by a voltage applied across the electrodes 11*a* and 11*b*.

The piezoelectric elements 11 remain charged at all times, preferably in the vicinity of an intermediate potential. The piezoelectric elements 11 are arranged so as to eject droplets from nozzles by applying pressure to the ink stored in corresponding nozzles when discharging is performed in accordance with the drive signal output from the head driver 12.

The head driver 12 is constituted as for example, a driver IC and generates drive signals COM to be delivered to a print head of an ink jet printer. This head driver 12 is disposed in, for example, a printer main unit.

The current amplifier 13 is constituted of two transistors 13*a*, 13*b*. Of these transistors, a collector of the first transistor 13*a* is connected to a constant-voltage power supply, and a base of the same is connected to an output terminal of the head driver 12. Further, an emitter of the first transistor 13*a* is connected to electrodes 11*a* of the piezoelectric elements 11. As a result, a constant voltage is supplied to the piezoelectric elements 11 in accordance with the signal output from the head driver 12.

An emitter of the second transistor 13*b* is connected to the electrodes 11*a* of the piezoelectric elements 11, and a base of the same is connected to another output terminal of the base drive circuit 12. As a result, in accordance with a signal output from the head driver 12, the second transistor 13*b* is brought into conduction, thereby causing the piezoelectric elements 11 to discharge.

Upon receipt of the control signal, the switcher 14 is turned on at the timing at which a corresponding piezoelectric element 11 is to be activated, thereby outputting the drive signal COM to that piezoelectric element 11.

The switcher 14 is formed as so-called transmission gates 14A, 14B, 14C, 14D for activating or deactivating the respective piezoelectric elements 11A, 11B, 11C, 11D.

Here, the head driver 12 and the current amplifier 13 are provided in the printer main unit, and the switcher 14 and the piezoelectric elements 11 are mounted on the print head.

Figures 2, 3:
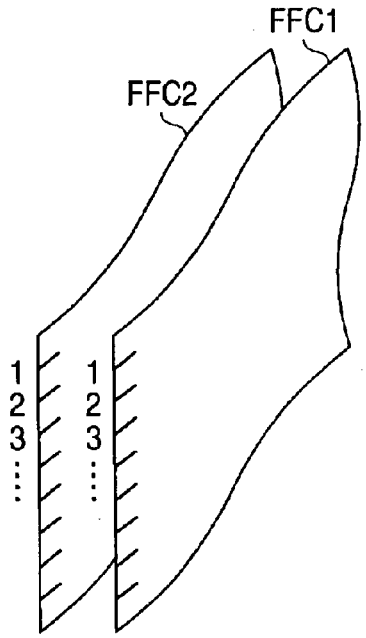
FIG. 2 is a schematic perspective view showing flexible flat cables provided in the ink jet printer.
FIG. 3 is a view showing allocation of signal lines of the flexible flat cables in the ink jet printer.

As in the case shown in FIG. 6, in relation to, wires 15 lying between the current amplifier 13 and the switcher 14, a drive signal line and a ground signal line, both provided for each row, are divided into two, respectively. As shown in FIG. 2, two flexible flat cables FFC1, FFC2 are used.

Here, as shown in FIG. 2, the flexible flat cables FFC1, FFC2 are set in a printer main unit in a superimposed manner.

The foregoing construction of the ink jet printer is analogous to that of a head drive device of the related-art ink jet printer. The ink jet printer 10 of the embodiment differs from the related-art ink jet printer in the manner of allocating drive signals COMA, COMB, COMC, and COMD and ground signals AGNDA, AGNDB, AGNDC, and AGNDD to respective signal lines of the flexible flat cables EFC1 and FFC2, which may be thought of as a means for reducing crosstalk.

In the ink jet printer 10, as shown in FIG. 3, the drive signals and ground signals of the respective nozzle rows A, B, C, and D are provided in the different flexible flat cables FFC1, FFC2 so as to oppose each other.

Further, in connection with the rows A and B, or the rows C and D, a drive signal and a ground signal are allocated to sequentially-arranged signal lines in the respective flexible flat cables FFC1, FFC2 so as to become arranged alternately.

The ink jet printer 10 of the embodiment is constructed in the manner set forth and operates in the following fashion.

When output from the head driver 12, the drive signal COM is supplied to the piezoelectric elements 11 by way of the switcher 14 in the form of the drive signals COMA, COMB, COMC, and COMD after having been amplified by the current amplifier 13.

The respective piezoelectric elements 11 are selectively activated in accordance with the drive signals COMA, COMB, COMC, and COMD, and respective nozzles of the nozzle rows eject ink droplets by dynamic pressure generated by the piezoelectric elements.

Here, the drive signals COMA, COMB, COMC, and COMD to be supplied to the respective elements 11 are output to the piezoelectric elements 11A, 11B, 11C, and 11D by way of the drive signal lines of the flexible flat cables FFC1, FFC2. Moreover, the ground signals AGNDA, AGNDB, AGNDC, and AGNDD serving as return signals for the drive signals flow into the ground signal lines of the flexible flat cables FFC1, FFC2.

At that time, drive and ground signals allocated to a single row; for example, the drive signal COMA and the ground signal AGNDA, both belonging to the row A, are allocated to mutually-opposing signal lines of the flexible flat cables FFC1, FFC2. Hence, as shown in FIG. 4, in a state in which the flexible flat cables FFC1, FFC2 remain close to each other, a magnetic field originating from the drive signal COMA and that originating from the ground signal AGNDA, both signals being allocated to the row A, cancel each other, and hence inductance is diminished.

Since signal lines allocated to other rows do not oppose each other, a certain distance is ensured between the signal lines, thereby reducing inter-row interference.

In this way, a reduction inter-row interference prevents occurrence of noise, which would otherwise be caused by crosstalk. Hence, there is prevented occurrence of distortion in a signal waveform of the drive signal COM, which would otherwise be caused by inter-row interference. As a result, the influence on the ejecting status of a nozzle row exerted by the number of ejection nozzles of another row is eliminated, and hence a distortion-free print result is obtained.

Figures 4, 5:
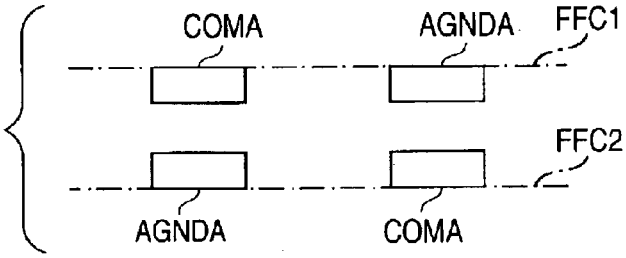
FIG. 4 is a fragmentary enlarged cross-sectional view of the flexible flat cables provided in the ink jet printer.
FIG. 5 is a view showing allocation of signal lines of flexible flat cables employed in an ink jet printer according to a second embodiment of the invention.

As shown in FIG. 5, an ink jet printer 20 according to a second embodiment is substantially identical in configuration with the ink jet printer 10 of the first embodiment, and they differ from each other in only the following points.

Specifically, the wires 15 extending between the power amplifier 13, the switcher 14, and the piezoelectric elements 11 are arranged such that drive and ground signals allocated to each row are split into three lines. The drive signals COMA, COMB, COMC, and COMD and the ground signals AGNDA, AGNDB, AGNDC, and AGNDD are allocated to these signal lines of the flexible flat cables FFC1, FFC2.

Here, drive and ground signal lines provided for the respective nozzle rows A, B, C, and D are arranged in the respective flexible flat cables FFC1, FFC2 so as to oppose each other. Moreover, in the flexible flat cables FFC1, FFC2, drive signals and ground signals are allocated to the signal lines sequentially provided in the respective flexible flat cables FFC1, FFC2 so as to become arranged alternately.

Accordingly, of the three drive signal lines for one row, two drive signal lines are allocated to one of the flexible flat cables, and the remaining drive signal line is allocated to the other one of the flexible flat cables.

The ink jet printer 20 of such a configuration operates in the same manner as does the ink jet printer 10 shown in FIG. 1, thereby performing printing operation. Moreover, in connection with a single row, for example, the row A, the drive signal COMA and the ground signal AGNDA are allocated to mutually-opposing signal lines in the flexible flat cables FFC1, FFC2. Hence, in a state in which the flexible flat cables FFC1, FFC2 are close to each other, a magnetic field originating from the drive signal COMA and that originating from the ground signal AGNDA, both signals being allocated to the row A, cancel each other, and hence inductance is diminished.

Since signal lines allocated to other rows do not oppose each other, a certain distance is ensured between the signal lines, thereby reducing interference developing between the rows.

Further, in the case of drive and ground signals of adjacent rows; for example, the drive signal COMA of the row A and the ground signal of the row B shown in FIG. 5, a signal line for the drive signal COMA and that for the ground signal are allocated so as to become adjacent to each other. Hence, overall inter-row inductance is reduced.

In the embodiments, the drive and ground signals of the respective nozzle rows are divided into the same number of signals; for example, two or three. However, the invention is not limited to the single number. For instance, a drive signal may be divided into two, and a ground signal may be divided into three.

Two flexible flat cables FFC1, FFC2 are employed in the embodiments. However, the invention is not limited to this number; three or more flexible flat cables may be employed.

In the embodiments, all the drive signals and ground signals are allocated to the mutually-opposing signal lines of the flexible flat cables FFC1, FFC2. However, the invention is not limited to these embodiments. In relation to only a part of the drive and ground signals; that is, to only rows of color nozzles which affect each other in terms of printed image quality, the drive and ground signal lines provided for the respective nozzle rows may be allocated to different flexible flat cables so as to oppose each other.

As a result, there can be substantially eliminated the deterioration of the printed image quality, which would otherwise be caused by noise induced by inter-row interference.

In the foregoing embodiments, the flexible flat cables FFC1, FFC2 are placed in a superimposed manner. The flat cables may be held while being spaced a given distance away from each other. Alternatively, an interference prevention member may be sandwiched between the flexible flat cables FFC1, FFC2.

As a result, interference arising between the rows of nozzles within the flexible flat cables FFC1, FFC2 can be eliminated in a more reliable manner.

The invention can be also applied to display manufacturing apparatuses, electrode forming apparatuses, biochip manufacturing apparatuses, or various types of liquid jetting apparatuses, as well as ink jet printers. Furthermore, the invention can be also applied to a jetting apparatus in which any kinds of gas is selected as a jetted object.

What is claimed is:

1. A jetting apparatus comprising:

a jetting head, provided with a plurality of rows of nozzles, a plurality of pressure generating elements associated with the respective nozzles to generate pressure to eject jetted objects from the nozzles;

a head driver, which generates a drive signal and a ground signal to be supplied to each of the pressure generating elements; and a plurality of flexible flat cables including signal lines connecting the head driver and the jetting head, the flexible flat cables arranged such that a first signal line for supplying the drive signal to one of the nozzle rows is provided in one of the flat cables and a second signal line for supplying the ground signal to the one of the nozzle rows opposes to the first signal line while being provided in another one of the flat cables.

2. The jetting apparatus as set forth in claim 1, wherein signal lines for supplying the drive signal and signal lines for supplying the ground signal are alternately arranged in each of the flexible flat cables.

3. The jetting apparatus as set forth in claim 1, wherein at least one of the first signal line and the second signal line is divided into a plurality of sublines.

4. The jetting apparatus as set forth in claim 1, wherein:

a third signal line for supplying the drive signal to another one of the nozzle rows is provided in one of the flat cables and a fourth signal line for supplying the ground signal to the another one of the nozzle rows opposes to the first signal line while being provided in another one of the flat cables; and jetting performances in the one of the nozzle rows and the another one of the nozzles affect with each other in relation to jetting performance accuracy.

5. The jetting apparatus as set forth in claim 1, wherein each adjacent flexible flat cables are arranged with a gap therebetween.

6. The jetting apparatus as set forth in claim 1, wherein a signal interference prevention member is provided between each adjacent flexible flat cables.

7. A jetting apparatus, comprising:

a jetting head, provided with a plurality of rows of nozzles, a plurality of pressure generating elements associated with the respective nozzles to generate pressure to eject jetted objects from the nozzles;

a head driver, which generates a drive signal and a ground signal to be supplied to each of the pressure generating elements; and a plurality of flexible flat cables including signal lines connecting the head driver and the jetting head, the flexible flat cables arranged such that a first signal line for supplying the drive signal to one of the nozzle rows is provided in one of the flat cables and a second signal line for supplying the drive signal to the one of the nozzle rows opposes to the first signal line while being provided in another one of the flat cables.

8. The jetting apparatus as set forth in claim 7, wherein signal lines for supplying the drive signal and signal lines for supplying the ground signal are alternately arranged in each of the flexible flat cables.

9. The jetting apparatus as set forth in claim 7, wherein at least one of the first signal line and the second signal line is divided into a plurality of sublines.

10. The jetting apparatus as set forth in claim 7, wherein:

a third signal line supplying the drive signal to another one of the nozzle rows is provided in one of the flat cables and a fourth signal line for supplying the ground signal to the another one of the nozzle rows opposes to the first signal line while being provided in another one of the flat cables; and jetting performances in the one of the nozzle rows and the another one of the nozzles affect each other in relation to jetting performance accuracy.

11. The jetting apparatus as set forth in claim 7, wherein each adjacent flexible flat cables are arranged with a gap therebetween.

12. The jetting apparatus as set forth in claim 7, wherein a signal interference prevention member is provided between each adjacent flexible flat cables.

13. A jetting apparatus, comprising:

a jetting head, provided with a plurality of rows of nozzles, a plurality of pressure generating elements associated with the respective nozzles to generate pressure to eject jetted objects from the nozzles;

a head driver, which generates a drive signal and a ground signal to be supplied to each of the pressure generating elements; and a plurality of flexible flat cables including signal lines connecting the head driver and the jetting head, the flexible flat cables arranged such that a first signal line for supplying the ground signal to one of the nozzle rows is provided in one of the flat cables and a second signal line for supplying the ground signal to the one of the nozzle rows opposes to the first signal line while being provided in another one of the flat cables.

14. The jetting apparatus as set forth in claim 13, wherein signal lines for supplying the drive signal and signal lines for supplying the ground signal are alternately arranged in each of the flexible flat cables.

15. The jetting apparatus as set forth in claim 13, wherein at least one of the first signal line and the second signal line is divided into a plurality of sublines.

16. The jetting apparatus as set forth in claim 13, wherein:

a third signal line for supplying the drive signal to another one of the nozzle rows is provided in one of the flat cables and a fourth signal line for supplying the ground signal to the another one of the nozzle rows opposes to the first signal line while being provided in another one of the flat cables; and jetting performances in the one of the nozzle rows and the another one of the nozzles affect each other in relation to jetting performance accuracy.

17. The jetting apparatus as set forth in claim 13, wherein each adjacent flexible flat cables are arranged with a gap therebetween.

18. The jetting apparatus as set forth in claim 13, wherein a signal interference prevention member is provided between each adjacent flexible flat cables.

19. A jetting apparatus, comprising:

pressure generating elements;

a head driver generating at least two respective signals for supply to the pressure generating elements; and signal lines between the head driver and the pressure generating elements;

wherein:

the signals are drive signals or ground signals;

the two respective signals supplied to a given one of the pressure generating elements are supplied over two different signal lines;

the two different signal lines are disposed in two distinct flexible flat cables; and the two different signal lines are respectively disposed within the two cables so that the signal lines oppose each other.

20. A jetting apparatus, comprising:

pressure generating elements;

a head driver generating at least two respective signals for supply to the pressure generating elements; and means for reducing crosstalk in signal lines between said head driver and said pressure generating elements.

21. The jetting apparatus according to claim 20, wherein:

said signals are drive signals or ground signals;

said means for reducing crosstalk comprises:

two different signal lines for supplying said signals to said pressure generating elements; and said two different signal lines being disposed in two distinct flexible flat cables, said two different signal lines are respectively disposed within said flexible flat cables so that said two different signal lines oppose each other.

22. A jetting apparatus, comprising:

a jetting head, provided with a plurality of rows of nozzles, a plurality of pressure generating elements associated with the respective nozzles to generate pressure to eject jetted objects from the nozzles;

a head driver, which generates a drive signal and a ground signal to be supplied to each of the pressure generating elements; and a plurality of flexible flat cables including signal lines connecting the head driver and the jetting head, wherein a first signal line group corresponding to one of the nozzles rows is provided in one of the flat cables and a second signal line group corresponding to the one of the nozzle rows is provided in another one of the flat cables so that the first signal line group and the second signal line group are opposed each other.

* * * * *